US008408129B2

(12) United States Patent
Schmid et al.

(10) Patent No.: US 8,408,129 B2
(45) Date of Patent: Apr. 2, 2013

(54) VACUUM RELIEF

(75) Inventors: Geoffrey F. Schmid, San Diego, CA (US); Kevin T. Kersey, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1145 days.

(21) Appl. No.: 11/625,032

(22) Filed: Jan. 19, 2007

(65) Prior Publication Data

US 2008/0174651 A1 Jul. 24, 2008

(51) Int. Cl.

| | |
|---|---|
| ***B41F 1/40*** | (2006.01) |
| ***B41F 1/28*** | (2006.01) |
| ***B41J 2/01*** | (2006.01) |

(52) U.S. Cl. ..... 101/474; 101/324; 347/14

(58) Field of Classification Search ..... 101/232, 101/474; 198/689.1; 248/362; 271/183, 271/194, 264, 276; 347/104; 355/73, 76
See application file for complete search history.

(56) References Cited

U.S. PATENT DOCUMENTS

| | | | | |
|---|---|---|---|---|
| 4,456,242 | A * | 6/1984 | Morin | 271/94 |
| 5,779,236 | A * | 7/1998 | Duncan et al. | 271/276 |
| 6,092,894 | A | 7/2000 | Nuita et al. | |
| 6,168,259 | B1 * | 1/2001 | Capurso | 347/36 |
| 6,957,887 | B2 | 10/2005 | Bruhn | |
| 2001/0046404 | A1 * | 11/2001 | Wotton et al. | 400/578 |
| 2002/0047885 | A1 * | 4/2002 | Miyawaki et al. | 347/104 |
| 2002/0060408 | A1 * | 5/2002 | Yraceburu et al. | 271/197 |
| 2002/0191065 | A1 * | 12/2002 | Temple et al. | 347/104 |
| 2003/0179273 | A1 | 9/2003 | Tsuji et al. | |
| 2004/0080102 | A1 * | 4/2004 | Hachimann et al. | 271/264 |
| 2004/0169712 | A1 | 9/2004 | Tsuji | |
| 2006/0109489 | A1 * | 5/2006 | Holtman | 358/1.1 |

* cited by examiner

*Primary Examiner* — Matthew Luu
*Assistant Examiner* — Kendrick Liu

(57) ABSTRACT

A surface has a vacuum and a vacuum relief.

9 Claims, 6 Drawing Sheets

VACUUM RELIEF

BACKGROUND

Printing media is sometimes held in place with a vacuum. The vacuum may sometimes draw and undesirably deposit printing material aerosol on a back side of the printing medium.

DETAILED DESCRIPTION OF THE EXAMPLE EMBODIMENTS

Figure 1:
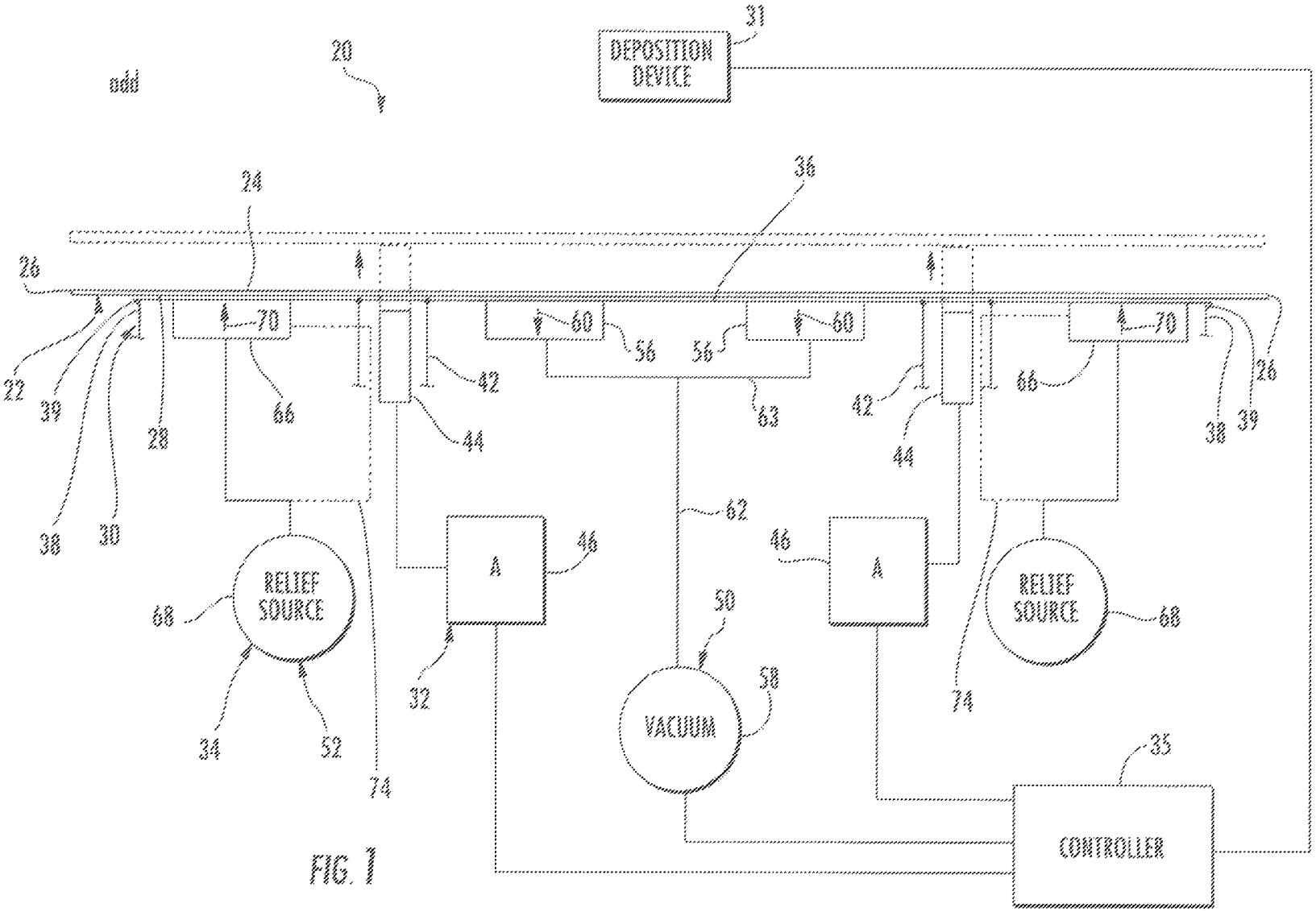
FIG. 1 is a sectional view schematically illustrating a deposition system according to an example embodiment.

FIG. 1 schematically illustrates media deposition system 20 according to an example embodiment. Media deposition system 20 is configured to securely hold and retain a panel or sheet 22 of media and to interact with the sheet 22 of media. In one embodiment, sheet 22 may comprise a sheet of cellulose material such as paper. In another embodiment, sheet 22 may comprise a sheet of one or more other materials. In the particular example embodiment illustrated, system 20 facilitates deposition of one or more materials, in dry form or fluid form, upon the face 24 of sheet 22 up to or in close proximity to edges 26 of sheet 22 while an opposite face 28 of sheet 22 is held, at least in part, by a vacuum. System 20 facilitates deposition of material in closer proximity to edge 26 without the same material being drawn onto the face 28 along edges 26.

System 20 includes media support 30, deposition device 31, media release system 32, media retention system 34 and controller 35. Media support 30 supports sheet 22. Media support 30 comprises a structure which includes support surface 36 terminating at edges 38. In the particular embodiment shown, support 30 additionally includes an elongate gasket or seal 39 comprising a resilient elastomeric lip extending about edge 38 up into abutment with surface 28 of sheet 22. Seal 39 provides an additional barrier against the flow of aerosols between support 30 and sheet 22. In other embodiments, seal 38 may be omitted.

Support surface 36 has dimensions so as to extend opposite to a majority of sheet 22 but slightly less than those corresponding dimensions of sheet 22 such that edges 26 of sheet 22 project beyond and overhang from edges 38 support 30. As a result, material may be deposited upon face 24 adjacent edges 26 without being substantially deposited upon support 30. In one embodiment, media support 30 has a length of less than 6 inches and a width of less than 4 inches for accommodating 4×6 photo media. In other embodiments, media support 30 has a length of less than 11 inches and a width of less then 8 ½ inches for accommodating 8.5×11 sheets of media.

In other embodiments, media support 30 may have other dimensions. In one embodiment, media support 30 comprises a plate, which serves as a platform for supporting sheet 22. In another embodiment, media support 30 may comprise a cylinder or a drum, wherein edges 38 are formed by axial ends of the cylinder or drum. In other embodiments, support 30 may have other configurations.

Deposition device 31 comprises a device configured to interact with sheet 22 while sheet 22 is retained against support 30 by media retention system 34. In one embodiment, deposition device 31 is configured to deposition material upon face 24 of sheet 22 adjacent to or in close proximity to edges 26. In one particular embodiment, deposition device 31 is configured to eject fluid onto face 24 and in close proximity to at least some of edges 26. According to one embodiment, deposition device 31 comprises a device configured to eject fluid ink. In one embodiment, deposition device 31 comprises one or more ink jet print heads, such as thermal inkjet print heads or piezo inkjet print heads. In one embodiment, deposition device 31 spans substantially an entirety of face 24 (both dimensions across the face) of sheet 22. In yet another embodiment, deposition device 31 spans substantially an entire first dimension of face 24 of sheet 22 and is configured to be scanned or moved to deposit material in the other dimension. In yet another embodiment, deposition device 31 is scanned in both dimensions while material is deposited upon sheet 22, which is stationary during such deposition or deposition device 31 is scanned in one dimension while support 30 is moved in the other dimension to achieve deposition of material in both dimensions along the face 24 of sheet 22.

Media release system 32 comprises an arrangement components configured to separate or release sheet 22 from support 30 and to facilitate removal of sheet 22 from support 30. In the particular example illustrated, media release system 32 is configured to lift sheet 22 from a lowered position (shown in solid lines) in which sheet 22 rests upon surface 36 to a raised position (shown in broken lines). By lifting sheet 22 to the raised position, media release system 32 facilitates engagement with an underside or lower face 28 of sheet 22 and edges 26 of sheet 22 with a hook, claw, catch or other sheet withdrawing mechanism. As a result, sheet 22 may be withdrawn from support 30 with reduced or no contact with the face 24 upon which material has been deposited, reducing undesirable marking or smears upon face 24. In those embodiments in which vacuum pressure is maintained by media retention system 34 during removal of sheet 22 from support 30, lifting of sheet 22 additionally breaks the vacuum hold to facilitate removal of sheet 22.

In the particular example embodiment illustrated, media release system 32 includes one or more lifter openings 42, one or more lifters 44 and one or more actuators 46. Lifter openings 42 extend through surface 36 at one or more locations along surface 36. Lifter openings 42 permit movement of lifters 44 from below to above surface 36. Although two lifter openings 42 are illustrated, in other embodiments, a greater or fewer of such lifter openings 42 may be provided in surface 36.

Lifters 44 comprise structures that are configured to be selectively engaged with face 28 of sheet 22 and to raise or lower sheet 22 with respect to surface 36. In the particular example illustrated, lifters 44 comprise fingers or other projections which or movable between a retracted position (shown in solid lines) in which lifters 44 are level with the surface 36 or are recessed below surface 36 within lifter openings 42 and an extended position (shown in broken lines) in which lifters 44 engage face 28 of sheet 22 and support and space sheet 22 above surface 36. Although media release system 32 is illustrated as including to lifters 44, in other embodiments, system 32 may include a greater or fewer of such lifters 44.

Actuators 46 comprise mechanisms configured to selectively move lifters 44 between the retracted and the extended positions. In one embodiment, actuators 46 pivot lifters 44 between the retracted and extended positions. In another embodiment, actuators 46 linearly move lifters 44 between the raised and lowered positions. In one embodiment, actuators 46 may comprise linear actuators such as hydraulic or pneumatic cylinder-piston assemblies or solenoids. In other embodiments, actuators 46 may comprise a rotary actuator and one or more appropriate cams. Although each of the lifters 44 is illustrated as having a dedicated actuator 46 independently controllable so as to independently actuate lifters 44, in other embodiments, a single actuator may be operably coupled to both lifters 44 to concurrently move lifters 44.

Media retention system 34 retains or holds sheet 22 in place relative to surface 36 of support 30 at least during deposition with sheet 22 by deposition device 31. Media retention system 34 retains sheet 22 by applying a vacuum between surface 36 and face 28 of sheet 22. At the same time, media retention system 34 reduces or eliminates such vacuum pressure proximate to edges 38 of the surface 36 to reduce the likelihood of air, which may contain aerosols of the material being deposited, from becoming drawn between sheet 22 and surface 36 along edges 38. As a result, such aerosols are less likely to become deposited upon face 28 of sheet 22.

Media retention system 34 includes vacuum system 50 and vacuum relief system 52. Vacuum system 50 creates a vacuum along least portions of surface 36 so as to draw face 28 of sheet 22 toward surface 36 to hold sheet 22 against lateral or sideways movement relative to surface 36. Vacuum system 50 includes one or more vacuum ports 56 and one or more vacuum sources 58. Vacuum ports 56 comprises openings, depressions, channels, gaps, grooves or other voids along surface 36 through which a vacuum force (schematically represented by arrows 60) is applied to an opposite sheet 22. Although vacuum system 50 is illustrates as including two spaced ports 56, in other embodiments, a greater or fewer of such ports 56 may be provided.

Vacuum source 58 comprises a device, such as a pump, configured to create a vacuum within each of ports 56. In one embodiment, vacuum source 58 creates a vacuum such that each of ports 56 has a pressure less than atmospheric pressure. According to one embodiment, vacuum source 58 includes vacuum manifold 62 underlying support 30. Vacuum manifold 62 is connected to a plenum 63, which forms a vacuum chamber below ports 56. In other embodiments, ports 56 may be pneumatically connected to independent vacuum sources such that different vacuum pressures may be applied to different ports 56.

According to one embodiment, ports 56 and vacuum source 58 are configured so as to create a negative pressure of at least about 40 inches $H_2O$ and nominally about 80 inches $H_2O$(3 PSI) at each of ports 56. In other embodiments, other negative pressures sufficient to retain sheet 22 against support 30 may be utilized.

Vacuum relief system 52 relives or reduces the vacuum along surface 36 of support 30 proximate to edges 38 of support 30 and proximate to edges 26 of sheet 22. As a result, potentially aerosol containing air is less likely to be drawn to the underside of sheet 22 along edges 26. Vacuum relief system 52 includes one or more vacuum reliefs 66 and one or more relief sources 68. Vacuum reliefs 66 comprise recesses, depressions, gaps, channels, grooves, cavities or other voids along surface 36 of support 30 through which air or other gases at a pressure less negative than the negative pressure applied by vacuum ports 56 (schematically represented by arrows 70) is applied to sheet 22. Vacuum reliefs 66 extend in close proximity to edges 38 of support 30 such that vacuum pressure is relieved proximate to edges 38. Vacuum reliefs 66 are located between edge 38 and vacuum ports 56. According to one embodiment, vacuum relief 66 are spaced from edges 38 by less than or equal to about 1.5 mm. In one embodiment, vacuum reliefs 66 may comprise one or more continuous elongate channels extending a proximate to edges 38. In still other embodiments, vacuum reliefs 66 may comprise a multitude of spaced depressions, each depression in communication with a relief source 68. In yet other embodiments, vacuum reliefs 66 may have other configurations.

Relief sources 68 comprise one or more sources of air or gas having a pneumatic pressure greater than the negative pressure applied by vacuum source 58 at each of ports 56. According to one embodiment, relief sources 68 comprise pneumatic passages or vents pneumatically connecting vacuum reliefs 66 to air at atmospheric pressure. For example, relief sources 68 may comprise vents extending from each of reliefs 66 to the a volume of air which is at atmospheric pressure, in one embodiment, the volume of air at atmospheric pressure may be a volume of layer beneath support 30. As a result, substantially clean air or air less likely to contain aerosols from deposition device 31 is provided through vacuum reliefs 66. In addition, the extent of piping, conduit or other structures to direct such air to reliefs 66 may be minimized due to the reduced distance between the source of air and vacuum reliefs 66.

As indicated by broken lines 74, in one embodiment, relief sources 68 may be provided by one or more pneumatic passages which extended from below support 30 at least partially through openings and 42 to vacuum reliefs 66. For example, lifter openings 42 may be in pneumatic communication with the underside of support 30. Additional channels or grooves along surface 36 or tubes or tunnels formed or provided within support 30 extending from openings 42 to the one or more vacuum reliefs 66 may be utilized to provide air at atmospheric pressure from the underside of support 30. As a result, opening 42 may have a dual purpose, reducing cost and complexity of system 20. In other embodiments, relief sources 68 may be distinct from lifter openings 42. Although vacuum relief system 52 is illustrated as having to vacuum reliefs 66 connected to independent relief sources 68, in other embodiments, a greater or fewer number of such vacuum reliefs may be provided. Moreover, one or more of vacuum reliefs 66 may share a common relief source 68.

Controller 35 comprises one or more processing units configured to generate control signals directing operation of vacuum system 50, deposition device 31 and release system 32. In the particular bottom illustrated, controller 35 also analyzes and manipulates data during the generation of such control signals. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiment, hard wired circuitry may be used in place of or in combination with software instructions to implement the functions described. For example, controller 92 may be embodied as part of one or more application-specific integrated circuits (ASICs). Unless otherwise specifically noted, the controller is not limited to any specific combination of hardware circuitry and software, nor to any particular source for the instructions executed by the processing unit.

In operation, a sheet 22 of media is placed upon support 30. Controller 35 generates control signals directing vacuum source 58 to apply a vacuum through vacuum ports 56. This results in sheet 22 being drawn and held against surface 36 of support 30. As sheet 22 is held against support 30, controller 35 generates control signals directing deposition device 31 to deposit one or more materials upon face 24 of sheet 22. According to one embodiment, controller 35 generates control signals directing deposition device 31 to selectively deposit and fluid or ink onto face 24 adjacent to or proximate to edges 26 of sheet 22. At the same time, vacuum relief sources 68 vent relatively cleaner air at atmospheric pressure to vacuum reliefs 66. As a result, air along edges 26, which may contain aerosols created by the ejection or spraying of material from deposition device 31, is less likely to be drawn in between surface 36 and sheet 22, reducing the likelihood of such aerosols depositing the material from deposition device 31 onto face 28 of sheet 22 proximate to edges 26.

Upon completion of the deposition of material on to face 24 of sheet 22, controller 35 generates control signals directing actuator's 46 to move lifters 44 from the lowered position (shown in solid lines) to be raised position shown in broken lines. This results in sheet 22 being lifted away from surface 36. In one embodiment, controller 35 additionally generates control signals terminating or lessening the vacuum applied by vacuum source 58. Lifting of sheet 22 facilitates removal of sheet 22 from support 30, readying support 30 for receiving another sheet 22.

Figure 2:
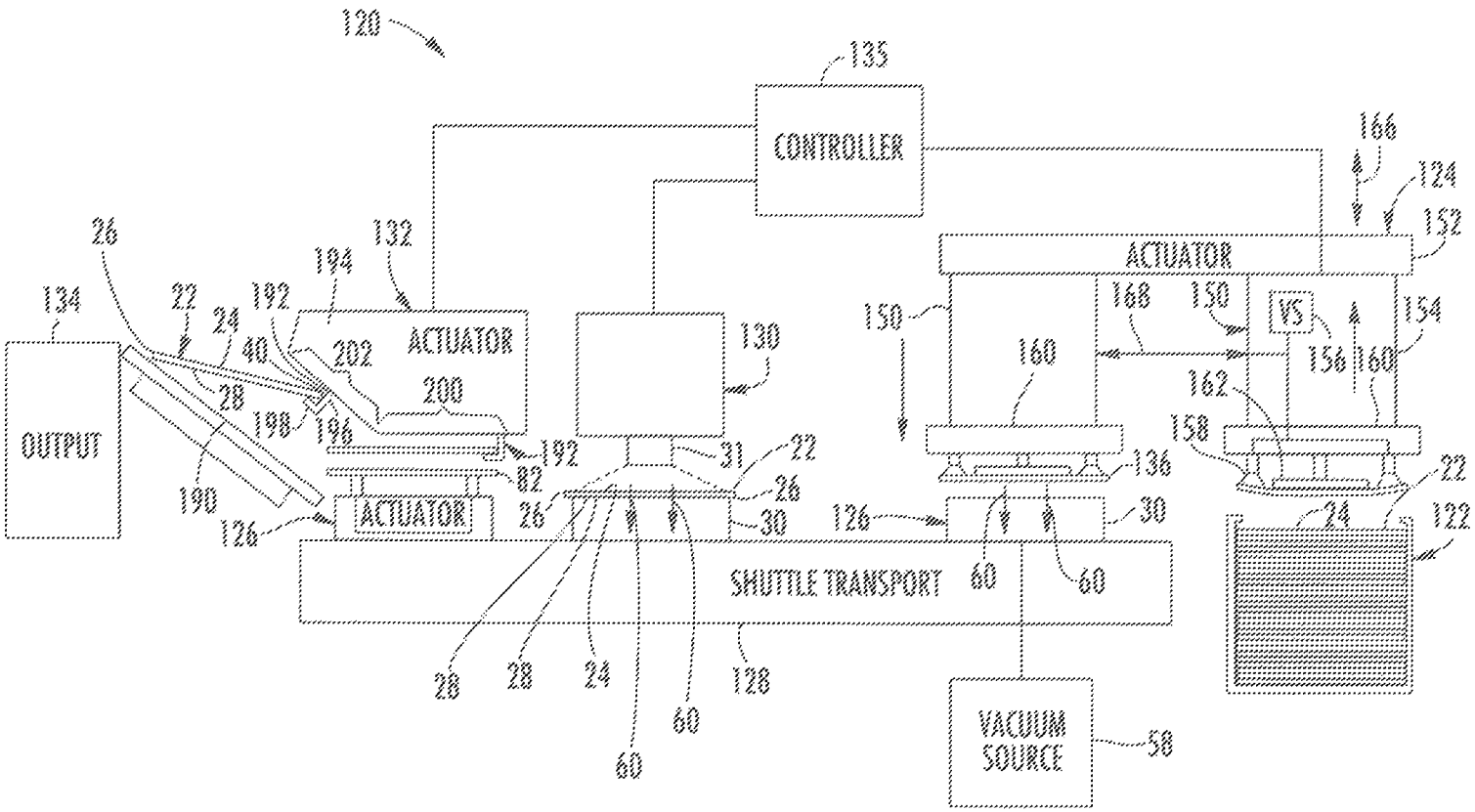
FIG. 2 is a schematic illustration of a printing system including the deposition system of FIG. 1 according to an example embodiment.

FIG. 2 schematically illustrates sheet deposition system 20 (described above with respect to FIG. 1) incorporated as part of sheet printing system 120 which is configured to handle sheets 22 of media and to deposit or print fluid, such as ink, upon such media. Printing system 120 generally includes sheet supply station 122, pick mechanism 124, shuttle tray 126 (shown at three positions), shuttle transport 128, deposition station 130, off-load station 132 and output 134. Sheet supply station 122 stores and supplies individual sheets 22 of media for printing system 120.

Pick mechanism 124 comprises a mechanism configured to pick the uppermost sheet 22 from sheet supply station 122 and to deposit the picked sheet 22 upon shuttle tray 126. Pick mechanism 124 includes pick unit 150 and actuator 152 (shown at two positions). Pick unit 150 picks or grasps the uppermost sheet 22 from sheet supply station 122 and generally includes body 154, vacuum source 156, vacuum cups 158 and pressure member 160. Body 154 is coupled to actuator 152 and generally houses and supports the remaining components of pick unit 150. Vacuum source 156 comprises a device configured to create a vacuum for each of vacuum cups 158. In one embodiment, vacuum source 156 comprises a blower carried by body 154 and in communication with cavities of vacuum cups 158. In other embodiments, other vacuum sources may be utilized.

Vacuum cups 158 generally comprise members extending from body 154 in communication with vacuum source 156 and configured to substantially seal against top face 144 of a sheet 22 while applying a vacuum to top face 24 so as to hold a sheet 22 against cups 158. Vacuum cups 158 are peripherally located about pressure member 160. In one embodiment, pick unit 150 includes four vacuum cups 158 configured to contact top face 24 of sheet 22 proximate to the four corners of sheet 22. In other embodiments, pick unit 150 may include a greater or fewer of such vacuum cups at other locations.

Pressure member 160 comprises a member having a surface 162 supported by and movable relative to body 154 between an extended position in which surface 162 extends beyond cups 158 and a retracted position in which surface 162 is substantially even with or withdrawn relative to the terminal portions of cups 158. Pressure member 160 is further configured such that surface 162 is resiliently biased towards the extended position. In the example shown, surface 162 is centrally located between vacuum cups 158 so as to generally contact the central portion of face 24 of a sheet 22 of media when picking a sheet of media.

Actuator 152 generally comprises a mechanism configured to move pick unit 150. In the particular example shown, actuator 152 is configured to raise and lower pick unit 150 relative to sheet supply station 122 as indicated by arrows 166. Actuator 152 is also configured to move pick unit 150 in the direction indicated by arrows 168 between a position generally opposite to sheet supply station 122 and another position generally opposite to shuttle tray 126. Actuator 152 may comprise a hydraulic or pneumatic cylinder-piston assembly, an electric solenoid, a motor and a transmission including one or more belts, pulleys, gear assemblies or cams or other mechanisms to actuate or move pick unit 150.

In response to receiving control signals from controller 135, actuator 152 lowers pick unit 150 towards an uppermost sheet 22 at sheet supply station 122 while surface 162 is in the extended position. As a result, surface 162 will initially contact top face 144 of an uppermost sheet 22. Continued lowering of pick unit 150 by actuator 152 results in surface 162 being moved to the retracted position as vacuum cups 158 are brought into contact with face 144 of sheet 22. In response to receiving signals from controller 135, vacuum source 156 applies a vacuum through vacuum cups 158 such that the uppermost sheet 22 is grasped. Thereafter, actuator 152 lifts pick unit 150 which results in the held sheet 22 also being lifted. During such lifting, surface 162 resiliently returns to its extended position, resulting in the corners of sheet 22 gripped by the vacuum of vacuum cups 158 being upwardly bent or curved to peel the uppermost sheet 22 from underlying sheets 22 at sheet supply station 122. Once a sheet 22 has been picked by pick unit 150, actuator 152 moves pick unit 150 to a position opposite to shuttle tray 126 and vacuum source 156 either terminates the supply of vacuum or blows air through vacuum cups 158 to release the grasped sheet 22 and to deposit the sheet 22 upon tray 126.

Shuttle tray 126 comprises a member configured to support and hold a sheet 22 of media as the media is transported from pick unit 150 to deposition station and to off-load station 132. Shuttle tray 126 is further configured to hold sheet 22 of media as material is deposited upon a face of sheet 22 at deposition station 130. Shuttle tray 126 includes media support 30, media release system 32 and media retention system 34 of sheet deposition system 20 as described above with respect to FIG. 1. Those elements of shuttle tray 126 which correspond to elements of sheet deposition system 20 are numbered similarly.

Shuttle transport 128 comprises a mechanism configured to move shuttle tray 126 between pick unit 150, deposition station 130 and off-load station 132. In one embodiment, shuttle transport 128 comprises an endless belt or chain coupled to shuttle tray 126 and configured to move shuttle tray 126 along the guides as a rod, bar or support surface. In another embodiment, shuttle transport 128 may comprise a motor and screw mechanism, a motor and rack and pinion mechanism, a hydraulic or pneumatic piston-cylinder assembly, an electric solenoid or other mechanisms configured to linearly translate shuttle tray 126.

Deposition station 130 comprises a station at which sheet 22 supported by shuttle tray 126 is printed upon. In the embodiment shown, deposition station 130 is configured to deposit fluid, such as ink, upon top face 24 of sheet 22. In the example shown, fluid is deposited upon face 24 while sheet 22 is held by vacuum applied through vacuum ports 56 (shown in FIG. 1) as indicated by arrows 60. In the particular embodiment illustrated, deposition station 130 includes deposition device 31 described above with respect to deposition system 20. Deposition device 31 is configured to deposit fluid, such as ink, across substantially the entire face 24 during a single pass of shuttle tray 126 relative to deposition station 130. In another embodiment, deposition station 130 and deposition device 131 may alternatively be configured to be moved or scanned relative to face 24 of sheet 22.

Off-load station 132 is configured to remove the printed upon sheet 22 from shuttle tray 126 and to transport the removed sheet to output 134. Off-load station 132 generally includes slide 190, trucks 192 and actuator 194. Slide 190 comprises a surface extending between platform surface 172 of shuttle tray 126 and output 134. In the particular example shown, slide 190 is inclined so as to form an upwardly extending ramp from shuttle tray 126 to output 134. As a result, output 134 may be positioned at a higher location to facilitate removal of printed upon sheets. In other embodiments, slide 190 may be supported at other orientations.

Trucks 192 comprise structures configured to engage and move a printed upon sheet 22 from shuttle tray 126 along slide 190 to output 134. Trucks 192 push sheet 22 in a generally horizontal direction across lifters 44 onto slide 90. When moving along the sheet transporting path 102, trucks 192 push sheet 22 along slide 190 into output 134.

Each truck 192 generally includes a leg 196 and a foot 198. Leg 196 extends from actuator 194 and is generally configured to engage or contact edge 26 of sheet 22. Foot 198 extends from leg 196 and is configured to extend along and contact a bottom face 28 of sheet 22. As a result, each truck 192 engages sheet 22 without substantially contacting printed upon face 24 to reduce the likelihood of smearing, scratching or otherwise damaging printed upon face 24 of sheet 22.

Actuator 194 comprises a device configured to move trucks 192 in response to control signals from controller 135. In one embodiment, actuator 194 comprises an endless belt, chain or web coupled to each of trucks 192 and driven by a motor or other torque source to move trucks 192 along paths 200, 202. In other embodiments, actuator 194 may have other configurations and may utilize other sources such as hydraulic or pneumatic piston-cylinder assemblies, solenoids and the like to move trucks 192 along paths 200, 202.

Output 134 generally comprises a structure configured to receive and potentially store printed upon sheets 22 until retrieved. In one embodiment, output 134 may comprise a tray. In another embodiment, output 134 may comprise a bin.

Controller 135 generally comprises a processing unit configured to generate control signals which are communicated to pick mechanism 124, shuttle tray 126, shuttle transport 128, deposition station 130 and off-load station 132 to direct the operation of such devices or stations. According to one example embodiment, controller 135 generates control signals initially directing pick mechanism 124 to pick and deposit a sheet 22 upon shuttle tray 126 as described in detail above. Thereafter, controller 135 generates control signals directing vacuum source and 158 to apply a vacuum through ports 56 to the sheet 22 placed upon support 30 of shuttle tray 126 and directs shuttle transport 128 to transfer shuttle tray 126 to deposition station 130. Once shuttle tray 126 and the sheet 22 it carries are positioned opposite deposition station 130, controller 35 generates control signals directing print device 186 to deposit fluid, such as ink, upon face 24 of sheet 22 while vacuum source 58 continues to hold sheet 22 in place by applying a vacuum through ports 56. As fluid is deposited upon sheet 22, vacuum reliefs 66 that air at a less negative pneumatic pressure or at atmospheric pressure to portions of support 30 proximate to edges 38. As a result, aerosol is less likely to deposit the fluid on the underside of sheet 22.

Upon completion of the deposition of fluid upon face 24 of sheet 22, controller 135 generates further control signals directing shuttle transport 128 to transfer shuttle tray 126 to off-load to a position opposite off-load station 132. Upon positioning of shuttle tray 126 at off-load station 132, controller 135 generates control signals directing actuator 46 to move lifers 44 to their extended positions and to optionally cease or reduce the application of vacuum by vacuum source 58. Controller 135 further generates control signals directing actuator 194 to drive trucks 192 such that trucks 192 engage face 28 and edge 26 to move sheet 22 off of lifters 44 and onto slide 190. In one embodiment, actuator 94 moves the off-loaded sheet 22 into output 134 without an interruption. In another embodiment, actuator 194 may temporarily pause with an off-loaded sheet 22 resting upon slide 190 while fluid or printing material dries or otherwise solidifies upon face 24. After a predetermined period of time, actuator 194 continues operation to continue to drive trucks 192 to move the sheet 22 to output 134.

FIGS. 3-6 illustrates deposition system 220, an example of deposition system 20, supporting a sheet 22. Like deposition system 20, deposition system 220 may be utilized as part of printing system 20 (shown in FIG. 2). In particular, the structures shown in FIGS. 3-6 may be incorporated as part of shuttle tray 126. Deposition system 220 includes media support 230, fluid receiver 231, media release system 232, sheet retention system 234, deposition device 31 (shown and described with respect to FIG. 1) and controller 35 (shown and described with respect to FIG. 1).

Support 230 comprises a structure which includes support surface 236 terminating at edges 238. Support surface 236 has dimensions so as to extend opposite to a majority of sheet 22 but slightly less than those corresponding dimensions of sheet 22 such that edges 26 of sheet 22 project beyond and overhang from edges 238 support 230. As a result, material may be deposited upon face 24 adjacent edges 26 without being substantially deposited upon support 30. In one embodiment, media support 230 has a length of less than 6 inches and a width of less than 4 inches for accommodating 4×6 photo media. In other embodiments, media support 230 has a length of less than 11 inches and a width of less than 8 ½ inches for accommodating 8.5×11 sheets of media. In other embodiments, media support 230 may have other dimensions.

Figure 4:
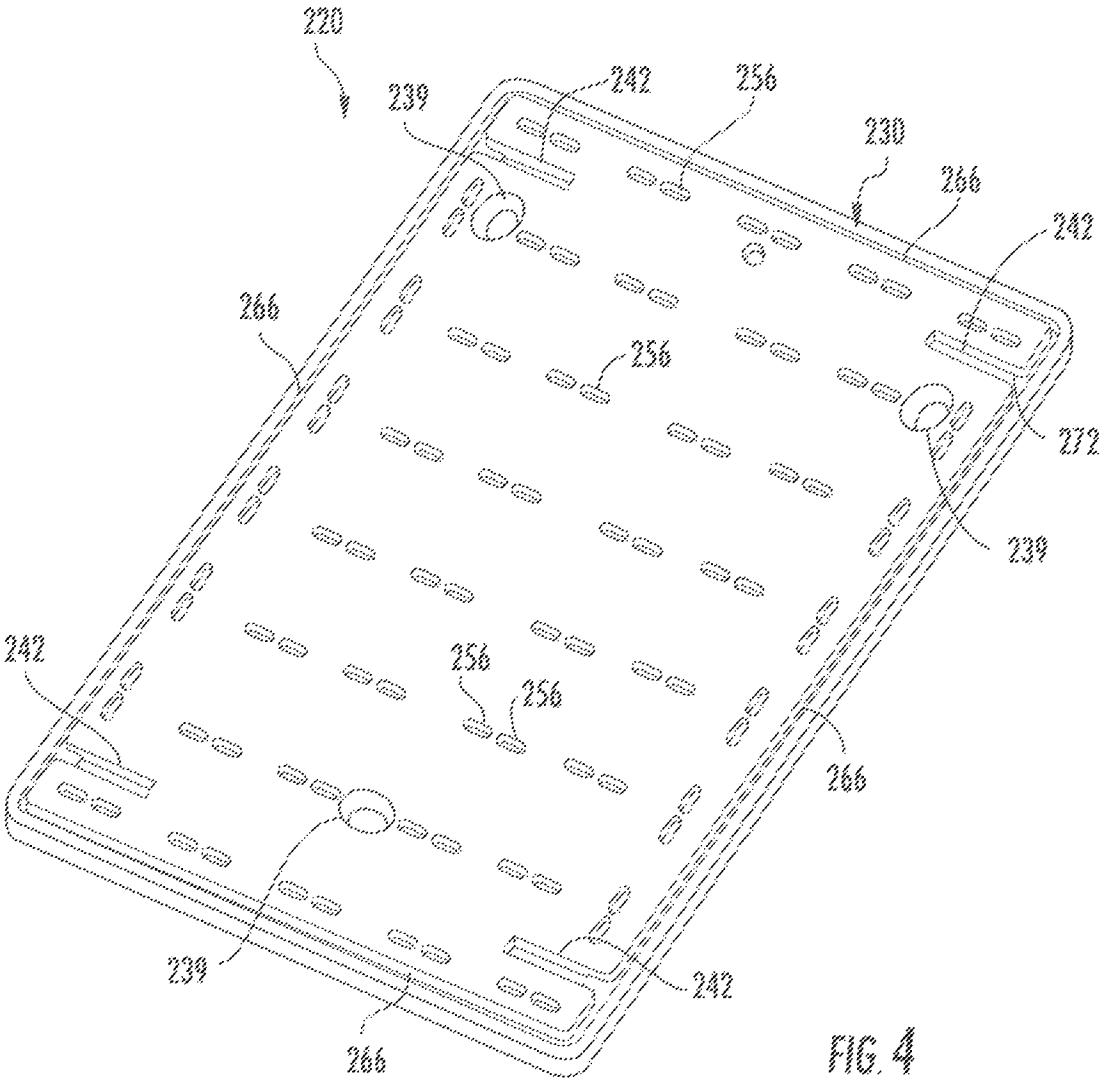
FIG. 4 is a top perspective view of a media support of the deposition system of FIG. 3 according to an example embodiment.
Figure 5:
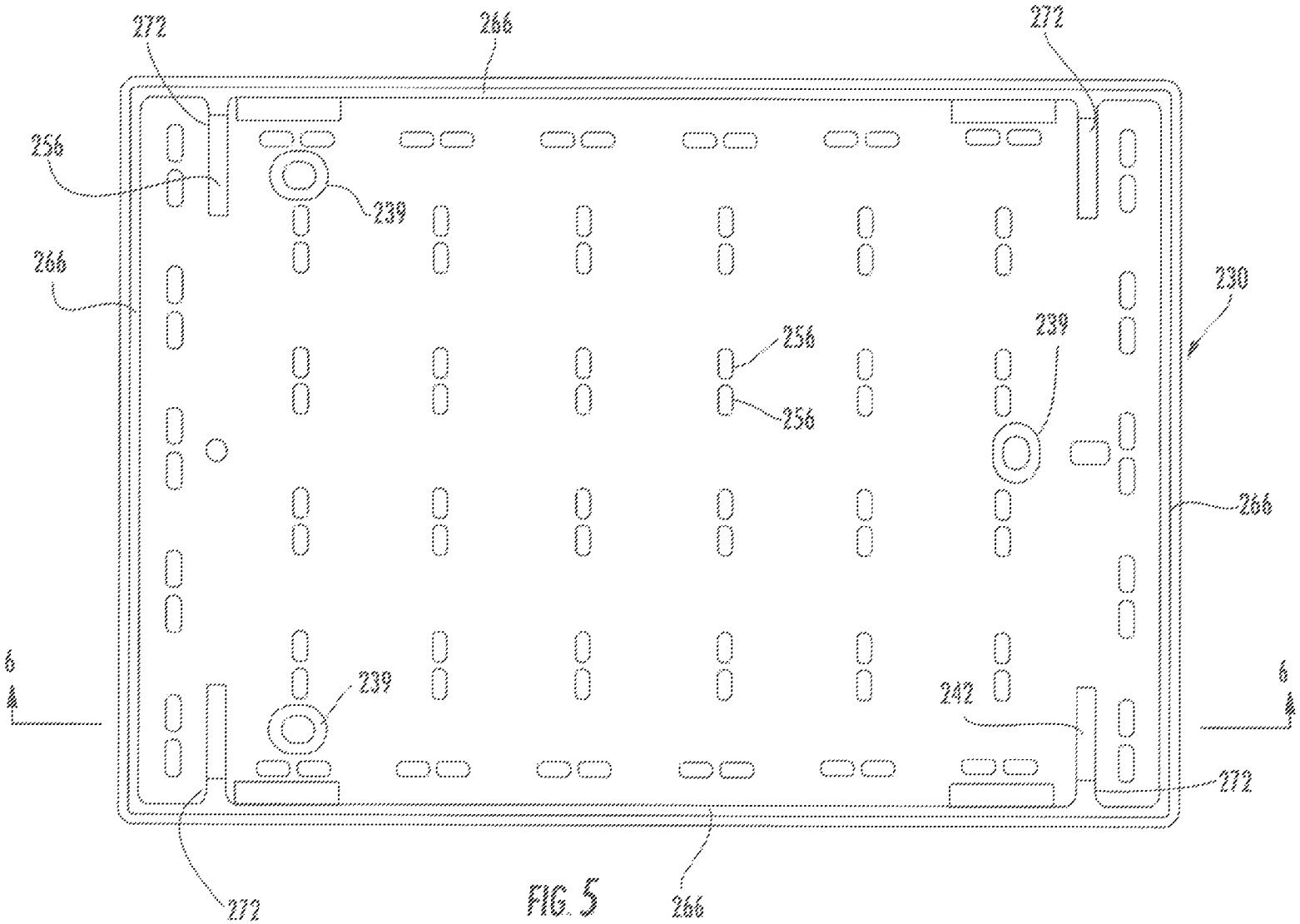
FIG. 5 is a top plan view of the media support of Figure numeral for according to an example embodiment.
Figure 6:
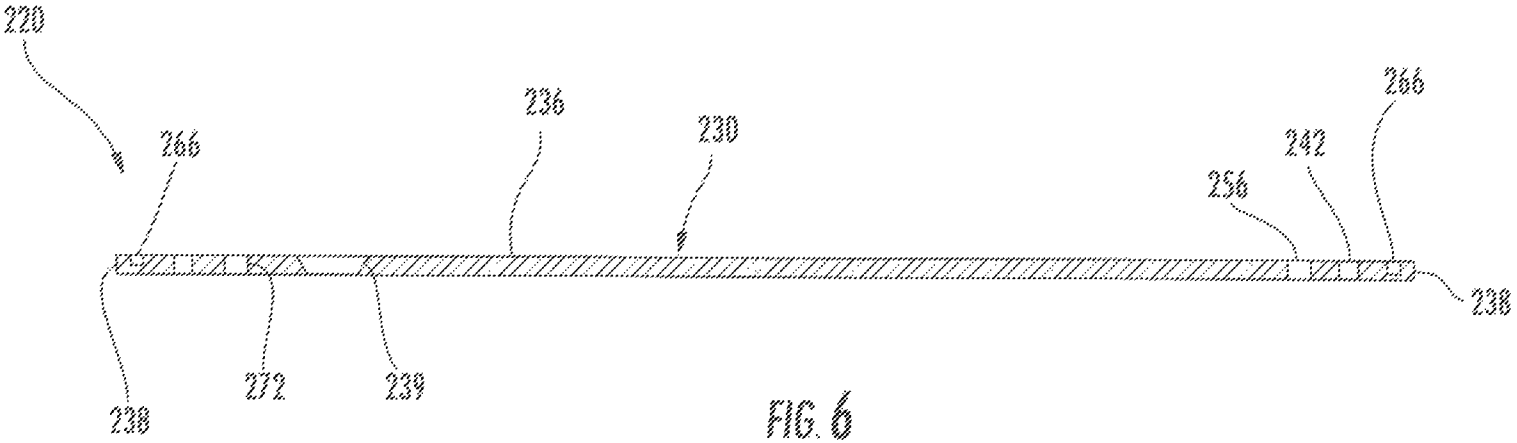
FIG. 6 is a sectional view of the media support of FIG. 5 taken along line 6-6 according to an example embodiment.

As shown by FIGS. 4-6, media support 230 comprises a plate which serves as a platform for supporting sheet 22. Media support 230 includes countersunk openings 239 facilitating connection of support 230 to an underlying supporting frame (not shown) or plenum 261. In another embodiment, media support 230 may comprise a cylinder or drum, wherein edges 238 are formed by axial ends of the cylinder or drum. In other embodiments, support 230 may have other configurations.

Figure 3:
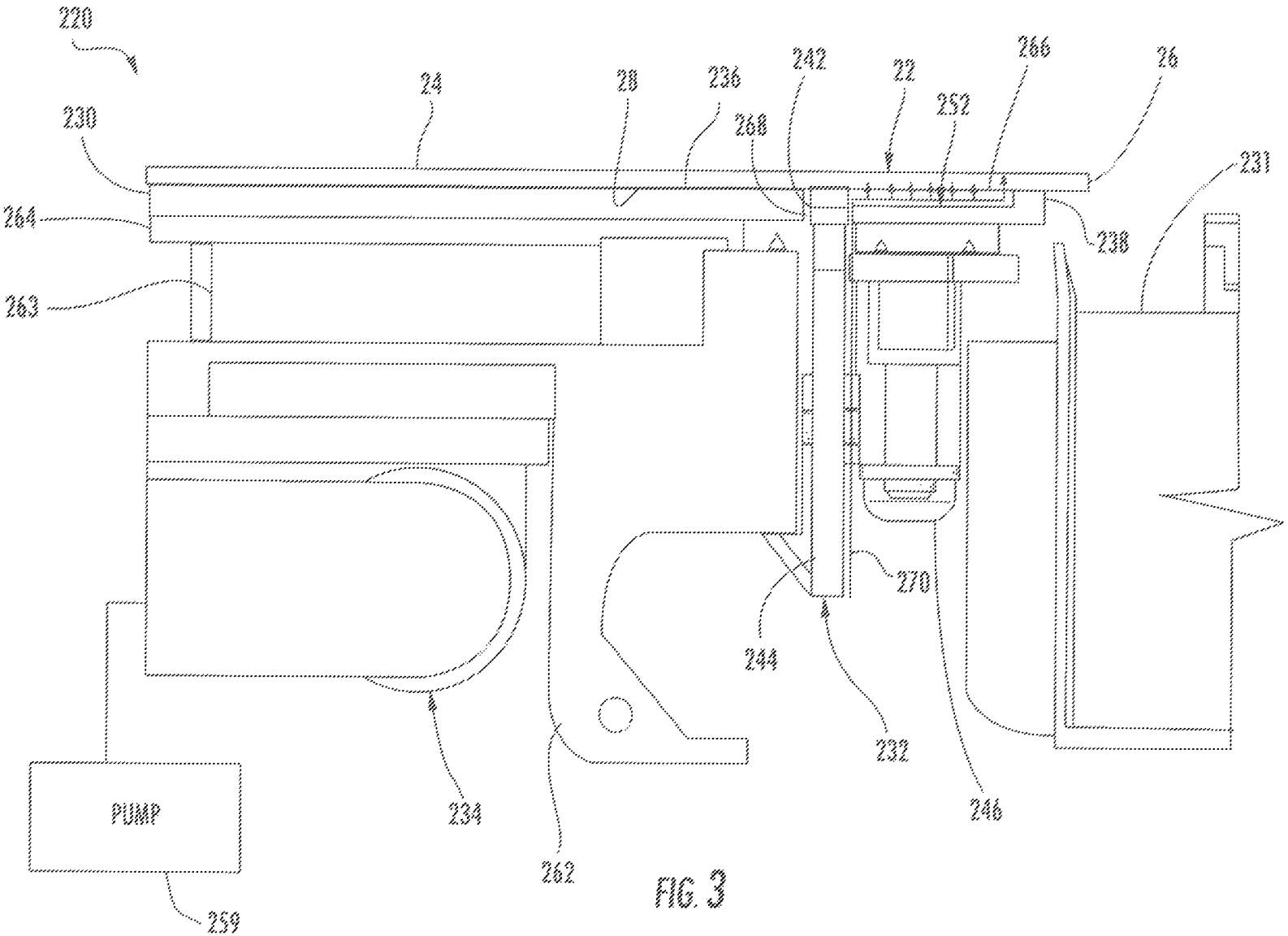
FIG. 3 is a fragmentary sectional view of another embodiment of the deposition system of FIG. 1 according to an example embodiment.

As shown by FIG. 3, fluid receiver 231 comprises a receptacle configured to catch or receive fluid along edge 238 of support 230. In one embodiment, fluid receiver 231 comprises a tray or other container configured to store fluid, such as ink, that has been caught. In one embodiment, receiver 231 may include a fluid absorbing element, such as a sponge or other absorbent material for retaining caught fluid. In another embodiment, receiver 231 may serve as a funnel for catching and channeling flow of captured fluid to another container (not shown). As shown by FIG. 3, fluid receiver 231 extends along at least a portion of edge 238 so to catch fluid from deposition device 31 (shown in FIG. 1) that has over sprayed edge 26 of sheet 22. In other embodiments, receiver 231 may be omitted.

Media release system 232 comprises an arrangement of components configured to separate or release sheet 22 from support 230 and to facilitate removal of sheet 22 from support 230. In the particular example illustrated, media release system 32 is configured to lift sheet 22 from a lowered position (shown in FIG. 3) in which sheet 22 rests upon surface 236 to a raised position elevated above surface 236. By lifting sheet 22 to the raised position, media release system 232 facilitates engagement with an underside or lower face 28 of sheet 22 and edges 26 of sheet 22 with a hook, claw, catch or other sheet withdrawing mechanism. As a result, sheet 22 may be withdrawn from support 230 with reduced or no contact with the face 24 upon which material has been deposited, reducing undesirable marking our smears upon face 24. In those embodiments in which vacuum pressure is maintained by media retention system 234 during removal of sheet 22 from support 230, lifting of sheet 22 additionally breaks the vacuum hold to facilitate removal of sheet 22.

In the particular example embodiment illustrated, media release system 32 includes lifter openings 242, lifters 244 (one of which is shown in FIG. 3) and actuator 246. Lifter openings 242 extend through surface 236 at one or more locations along surface 236. Lifter openings 242 permit movement of lifters 244 from below to above surface 236. As shown in FIGS. 4 and 5, in the particular example illustrated, system 232 includes four lifter openings 242 located proximate to each corner of support 230. In other embodiments, a greater or fewer of such lifter openings 242 at other locations may be provided.

Lifters 244 (one of which is shown in FIG. 3) comprise structures configured to be selectively engaged with face 28 of sheet 22 and to raise or lower sheet 22 with respect to surface 236. In the particular example illustrated, lifters 244 comprise fingers or other projections which or movable between a retracted position in which lifters 244 are level with the surface 36 or are recessed below surface 236 within lifter openings 242 and an extended position in which lifters 244 engage face 28 of sheet 22 and support and space sheet 22 above surface 236. In the particular example illustrated, system 232 includes four lifters 244 (one of which is shown) located proximate to each of the corners of support 230 adjacent to the four lifter openings 242 (shown in FIG. 4). In other embodiments, a greater or fewer of such lifters 244 may be provided.

Actuator 246 comprises a mechanisms configured to selectively move lifters 244 between the retracted and the extended positions. In one embodiment, actuator 246 pivots lifters 244 between the retracted and extended positions. In the particular embodiments illustrated, actuator 246 comprises a rotary actuator such as a motor and one or more appropriate cams (not shown). In another embodiment, actuator 246 may alternatively linearly move lifters 244 between the raised and lowered positions. In one embodiment, actuator 246 may comprise a linear actuator such as a hydraulic, pneumatic cylinder-piston assembly or a solenoid.

Media retention system 234 retains or holds sheet 22 in place relative to surface 236 of support 230 at least during deposition with sheet 22 by deposition device 31. Media retention system 234 retains sheet 22 by applying a vacuum between surface 236 and face 28 of sheet 22. At the same time, media retention system 234 reduces or eliminates such vacuum pressure proximate to edges 238 of the surface 36 to reduce the likelihood of air, which may contain aerosols of the material being deposited, from becoming drawn between sheet 22 and surface 236 along edges 238. As a result, such aerosols are less likely to become deposited upon face 28 of sheet 22.

Media retention system 234 includes vacuum system 250 and vacuum relief system 252. Vacuum system 250 creates a vacuum along least portions of surface 236 so as to draw face 28 of sheet 22 toward surface 236 to hold sheet 22 against lateral or sideways movement relative to surface 36. Vacuum system 250 includes one or more vacuum ports 256 (shown in FIGS. 4-6) and vacuum source 258. Vacuum ports 256 comprise openings along surface 236 through which a vacuum force is applied to an opposite sheet 22. As shown in FIGS. 4 and 5, vacuum ports 256 are arranged in pairs which extend along substantially an entire surface of media support 230. In other embodiments, vacuum ports 256 may have other configurations, patterns and locations.

As shown by FIG. 3, vacuum source 258 comprises a device, such as a pump, configured to create a vacuum within each of ports 256. In the example embodiment illustrated, vacuum source 258 comprises a pump 259 (schematically shown) a vacuum manifold 262 and a plenum 263. Pump 259 applies a vacuum to an underside of media support 230 through manifold 262 and plenum 263, which is sealed against support 230 by a gasket 264. In one embodiment, vacuum source 258 is configured to create a vacuum such that each of ports 256 has a pressure less than atmospheric pressure. According to one embodiment, ports 256 and vacuum source 258 are configured so as to create a pressure of at least about 40 inches $H_2O$ and nominally about 80 inches $H_2O$(3 PSI) in each of ports 56. In other embodiments, other negative pressures sufficient to retain sheet 22 against support 230 may be utilized.

Vacuum relief system 252 relieves or reduces the vacuum along surface 236 of support 230 proximate to edges 238 of support 230 and proximate to edges 26 of sheet 22. As a result, potentially aerosol containing air is less likely to be drawn to the underside of sheet 22 along edges 26. Vacuum relief system 252 includes one or more vacuum reliefs 266 and one or more relief sources 268. Vacuum reliefs 266 comprise recesses, depressions, gaps, channels, grooves, cavities or other voids along surface 236 of support 230 through which air or other gases at a pressure less negative than the negative pressure applied by vacuum ports 256 is applied to sheet 22. As shown by FIGS. 4 and 5, vacuum reliefs 266 extend in close proximity to edges 238 of support 230 such that vacuum pressure is relieved proximate to edges 38. As shown by FIGS. 4 and 5, vacuum reliefs 266 are located between edge 238 and vacuum ports 256. According to one embodiment, vacuum reliefs 266 are spaced from edges 238 by less than or equal to about 1.5 mm. As shown by FIG. 5, vacuum reliefs 266 comprise one or more continuous elongate channels extending a proximate to edges 238. In still other embodiments, vacuum reliefs 266 may comprise a multitude of spaced depressions, each depression in communication with a relief source 268. In yet other embodiments, vacuum reliefs 266 may have other configurations.

Relief sources 268 comprise sources of air or gas having a pneumatic pressure greater than the negative pressure applied by vacuum source 258 at each of ports 256. According to one embodiment, relief sources 268 comprise pneumatic passages or vents pneumatically connecting vacuum reliefs 266 to air at atmospheric pressure. For example, relief sources 268 comprise vents extending from each of reliefs 266 to a volume of air which is at atmospheric pressure. In the example illustrated, the volume of air at atmospheric pressure is the volume of air beneath support 230 and beneath manifold 260. As a result, clean air or air less likely to contain aerosols from deposition device 31 is provided through vacuum reliefs 266. In addition, the extent of piping, conduit or other structure to direct such air to reliefs 266 may be minimized due to the reduced distance between the source of air and vacuum reliefs 266.

In the particular example illustrated, relief sources 268 comprise pneumatic passages 270 which extend from below support 230 at least partially through lifter openings 242 to vacuum reliefs 66. As shown by FIG. 5, lifter openings 242 are in pneumatic communication with the underside of support 230 and are in communication with reliefs 266 via connecting passages 272. As a result, opening 242 may have a dual purpose, reducing cost and complexity of system 220.

In other embodiments, relief sources 68 may be distinct from lifter openings 42. Although vacuum relief system 252 is illustrated as having a single continuous vacuum relief 266 comprising an elongate channel along a perimeter of support 230 and which is in pneumatic communication with each of four lifter openings 242, in other embodiments, relief system 252 may alternatively include two or more distinct reliefs 266. In other embodiments, additional channels or grooves along surface 236 or tubes or tunnels formed or provided within support 230 extending from openings 242 to the one or more vacuum reliefs 266 may be utilized to provide air at atmospheric pressure from the underside of support 230.

In operation, a sheet 22 of media is placed upon support 230. Controller 35 (shown in FIG. 1) generates control signals directing vacuum source 258 to apply a vacuum through vacuum ports 256. This results in sheet 22 being drawn and held against surface 236 of support 230. As sheet 22 is held against support 230, controller 35 generates control signals directing deposition device 31 (shown in FIG. 1) to deposit one or more materials upon face 24 of sheet 22. According to one embodiment, controller 35 generates control signals directing deposition device 31 to selectively deposit and fluid or ink onto face 24 adjacent to or proximate to edges 26 of sheet 22. At the same time, vacuum relief sources 268 vent relatively cleaner air at atmospheric pressure to vacuum reliefs 266. As a result, air along edges 26, which may contain aerosols created by the ejection or spraying of material from deposition device 31, is less likely to be drawn towards in between surface 236 and sheet 22, reducing the likelihood of such aerosols depositing the material from deposition device 31 onto face 28 of sheet 22 proximate to edges 26.

Upon completion of the deposition of material on to face 24 of sheet 22, controller 35 generates control signals directing actuator 246 to move lifters 244 from the lowered position to a raised position. This results in sheet 22 being lifted away from surface 236. In one embodiment, controller 35 additionally generates control signals terminating or lessening the vacuum applied by vacuum source 258. Lifting of sheet 22 facilitates removal of sheet 22 from support 230, readying support 230 for receiving another sheet 22.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:
a surface having a perimeter edge;
vacuum ports extending through the surface;
a vacuum source in communication with the ports and at a first pressure; and
a vacuum relief proximate to the edge of the surface and at a second pressure greater than the first pressure, wherein the vacuum relief comprises a groove completely encircling the vacuum ports.

2. An apparatus comprising:
a surface having a perimeter edge;
vacuum ports extending through the surface;
a vacuum source in communication with the ports and at a first pressure;
a vacuum relief proximate to the edge of the surface and at a second pressure greater than the first pressure; and
a fluid ejection device configured to eject fluid over the surface;
wherein the vacuum relief comprises a groove completely encircling the vacuum ports.

3. An apparatus comprising:
a surface having a perimeter edge;
vacuum ports extending through the surface;
a vacuum source in communication with the ports and at a first pressure;
a vacuum relief proximate to the edge of the surface and at a second pressure greater than the first pressure;
a fluid ejection device configured to eject fluid over the surface;
an opening through the surface and in connection with the vacuum relief; and
a media lift movable between a first position in which the lift extends through the opening and projecting above the surface and a second position at or below the surface.

4. An apparatus comprising:
a surface having a perimeter edge;
vacuum ports extending through the surface;
a vacuum source in communication with the ports and at a first pressure;
a vacuum relief proximate to the edge of the surface and at a second pressure greater than the first pressure, wherein the vacuum relief is at atmospheric pressure;
an opening through the surface and in connection with the vacuum relief; and
a media lift movable between a first position in which the lift extends through the opening and projecting above the surface and a second position at or below the surface.

5. An apparatus comprising:
a surface having a perimeter edge;
vacuum ports extending through the surface;
a vacuum source in communication with the ports and at a first pressure;
a vacuum relief proximate to the edge of the surface and at a second pressure greater than the first pressure, wherein the vacuum relief is at atmospheric pressure;
a fluid ejection device configured to eject fluid over the surface and across the edge;

an opening through the surface and in connection with the vacuum relief; and a media lift movable between a first position in which the lift extends through the opening and projecting above the surface and a second position at or below the surface.

6. An apparatus comprising:

a surface having a perimeter edge;

vacuum ports extending through the surface;

a vacuum source in communication with the ports and at a first pressure;

a deposition device configured to deposit material onto a first face of a sheet of media retained in place relative to the surface by the first pressure of the vacuum source applied between the surface and a second face of the sheet of media; and a vacuum relief proximate to the edge of the surface and at a second pressure greater than the first pressure to direct the second pressure to the perimeter edge of the surface to inhibit aerosol containing the material of the deposition device from being drawn along the perimeter edge between the sheet and the surface and deposited on the second face of the sheet of media;

wherein the vacuum relief comprises a groove completely encircling the vacuum ports.

7. An apparatus comprising:

surface having a perimeter edge;

vacuum ports extending through the surface;

a vacuum source in communication with the ports and at a first pressure;

a deposition device configured to deposit material onto a first face of a sheet of media retained in place relative to the surface by the first pressure of the vacuum source applied between the surface and a second face of the sheet of media;

a vacuum relief proximate to the edge of the surface and at a second pressure greater than the first pressure to direct the second pressure to the perimeter edge of the surface to inhibit aerosol containing the material of the deposition device from being drawn along the perimeter edge between the sheet and the surface and deposited on the second face of the sheet of media;

an opening through the surface and in connection with the vacuum relief; and a media lift movable between a first position in which the lift extends through the opening and projecting above the surface and a second position at or below the surface.

8. An apparatus comprising:

a surface having a perimeter edge;

vacuum ports extending through the surface;

a vacuum source in communication with the ports and at a first pressure;

a vacuum relief proximate to the edge of the surface and at a second pressure greater than the first pressure, wherein the vacuum relief is at atmospheric pressure;

an opening through the surface and in connection with the vacuum relief; and a media lift movable between a first position in which the lift extends through the opening and projecting above the surface and a second position at or below the surface.

9. An apparatus comprising:

a surface having a perimeter edge;

vacuum ports extending through the surface;

a vacuum source in communication with the ports and at a first pressure;

a vacuum relief proximate to the edge of the surface and at a second pressure greater than the first pressure, wherein the vacuum relief is at atmospheric pressure;

a fluid ejection device configured to eject fluid over the surface and across the edge;

an opening through the surface and in connection with the vacuum relief; and a media lift movable between a first position in which the lift extends through the opening and projecting above the surface and a second position at or below the surface.

* * * * *

UNITED STATES PATENT AND TRADEMARK OFFICE

CERTIFICATE OF CORRECTION

PATENT NO. : 8,408,129 B2
APPLICATION NO. : 11/625032
DATED : April 2, 2013
INVENTOR(S) : Geoffrey F. Schmid et al.

It is certified that error appears in the above-identified patent and that said Letters Patent is hereby corrected as shown below:

In the Claims:

In column 13, line 26, in Claim 7, before "surface" insert -- a --.

Signed and Sealed this
Sixth Day of August, 2013

Teresa Stanek Rea
*Acting Director of the United States Patent and Trademark Office*